US007396092B2

(12) United States Patent
Prentner et al.

(10) Patent No.: US 7,396,092 B2
(45) Date of Patent: Jul. 8, 2008

(54) SLIDING GUIDE FOR DRAWERS AND OTHER FURNITURE PARTS SLIDE OUT OF THE BODY OF A PIECE OF FURNITURE

(75) Inventors: Christian Prentner, Osterreich (AT); Günter Grabher, Fussach (AT)

(73) Assignee: Alfit AG, Goetzis (AU)

( * ) Notice: Subject to any disclaimer, the term of this patent is extended or adjusted under 35 U.S.C. 154(b) by 181 days.

(21) Appl. No.: 10/519,220

(22) PCT Filed: Jun. 20, 2003

(86) PCT No.: PCT/EP03/06547

§ 371 (c)(1),
(2), (4) Date: Jun. 22, 2005

(87) PCT Pub. No.: WO04/000071

PCT Pub. Date: Dec. 31, 2003

(65) Prior Publication Data

US 2006/0049732 A1 Mar. 9, 2006

(30) Foreign Application Priority Data

Jun. 21, 2002 (DE) ..... 202 09 690 U

(51) Int. Cl.
*A47B 88/00* (2006.01)

(52) U.S. Cl. ..... 312/334.6; 312/334.12

(58) Field of Classification Search ... 312/334.6–334.9, 312/334.12–334.16, 334.18, 334.25, 334.26, 312/334.33, 334.36, 334.37, 334.39, 334.45; 384/18, 19

See application file for complete search history.

(56) References Cited

U.S. PATENT DOCUMENTS

| | | | | |
|---|---|---|---|---|
| 4,351,575 | A * | 9/1982 | Rock et al. | 384/18 |
| 6,682,160 | B2 * | 1/2004 | Kung | 312/334.6 |
| 2004/0227444 | A1 * | 11/2004 | Booker et al | 312/334.45 |
| 2007/0057608 | A1 * | 3/2007 | Chiu | 312/334.1 |

FOREIGN PATENT DOCUMENTS

| | | | |
|---|---|---|---|
| AT | 360 699 | | 1/1981 |
| AT | 2 137 074 | | 12/1999 |
| DE | 75 24 772 | | 3/1976 |
| EP | 694270 | * | 7/1995 |
| GB | 2195075 | * | 3/1988 |
| WO | 2004100710 | * | 11/2004 |
| WO | 2006052999 | * | 5/2006 |

* cited by examiner

*Primary Examiner*—Janet M Wilkens
(74) *Attorney, Agent, or Firm*—Christa Hildebrand; Norris McLaughlin & Marcus, PA

(57) ABSTRACT

Pull-out guide (10) for furniture parts with a running rail (14) fixable to a furniture part and a carcass rail (12) fixable on the furniture carcass as well as and a central rail (16) which is provided between these two rails. The rails are guided so as to be longitudinally displaceable relative to one another by load-transmitting anti-friction bearings which are in each case retained rotatably in cages (22). The anti-friction bearings are constructed in a manner known per se as cylindrical rollers (30; 34) which are retained in the associated cage (22) so as to be rotatable transversely with respect to the pull-out direction about a horizontal or vertical as in each case, and which can roll on elongate planar tracks constructed on the respectively associated rails. At least some of the rollers (30) are mounted so as to be rotatable about the horizontal axis and are disposed in the respectively associated cage (22) so as to be offset with respect to one another laterally in the direction of their longitudinal central axes relative to other rollers (30) which are mounted in the same cage (22) so as to be rotatable about the horizontal axis.

8 Claims, 3 Drawing Sheets

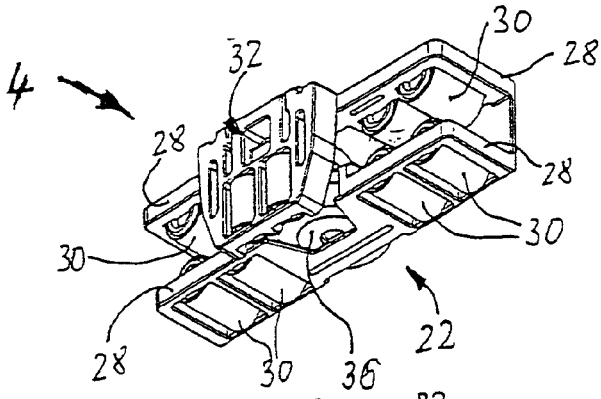
Fig. 3
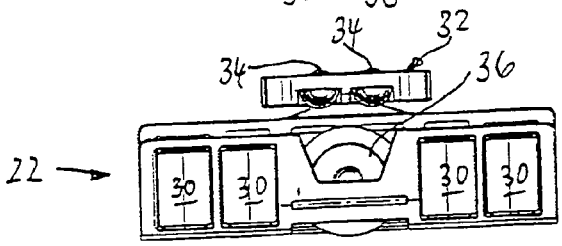
Fig. 6
Fig. 8
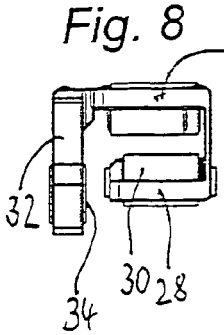
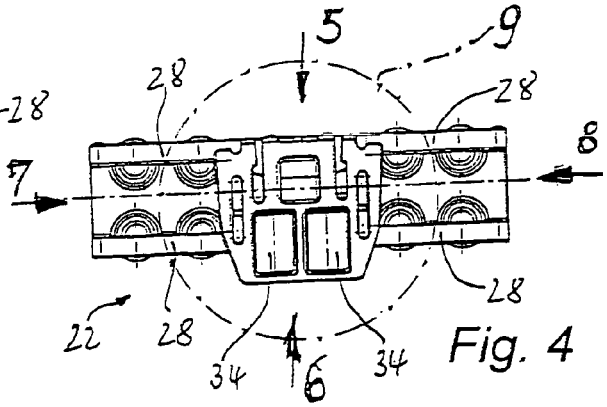
Fig. 4
Fig. 7
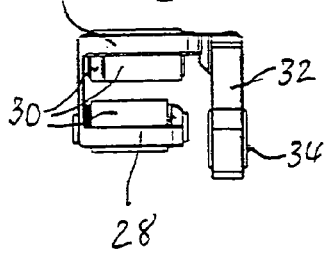
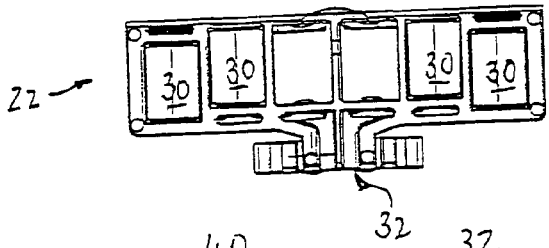
Fig. 5
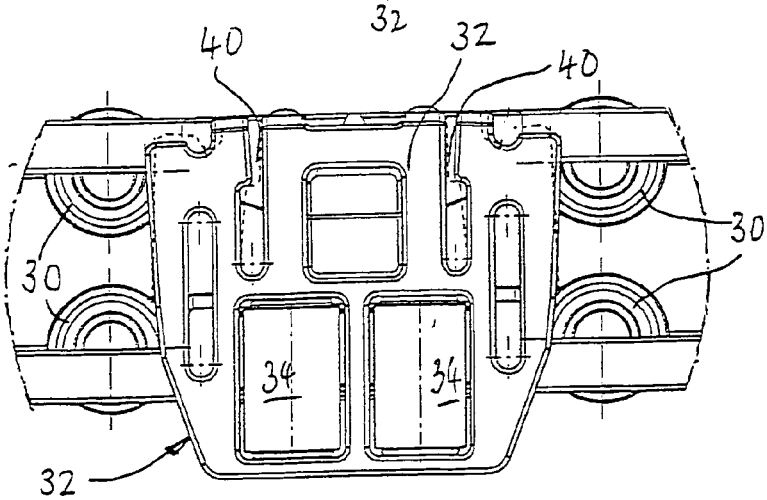
Fig. 9

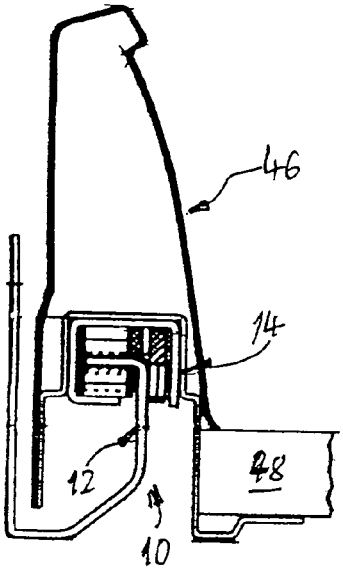
Fig. 10
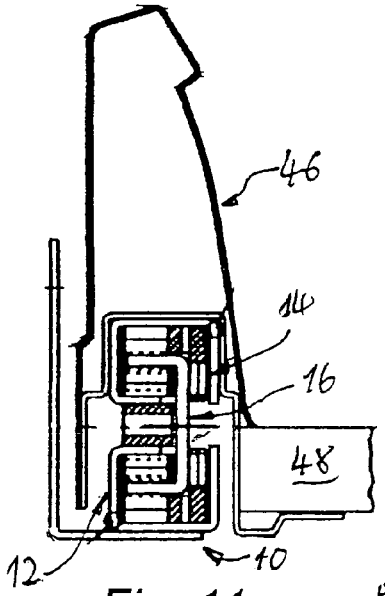
Fig. 11
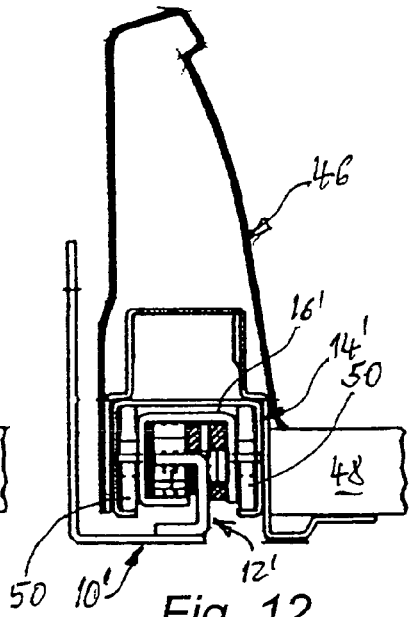
Fig. 12
Fig. 13
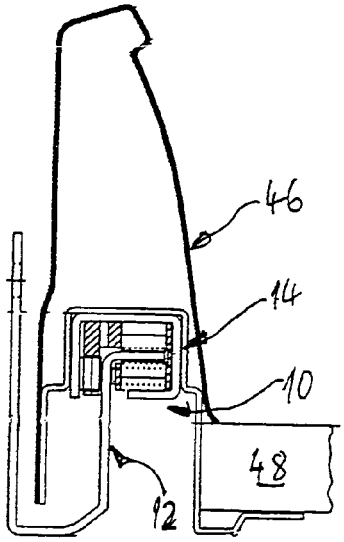
Fig. 14
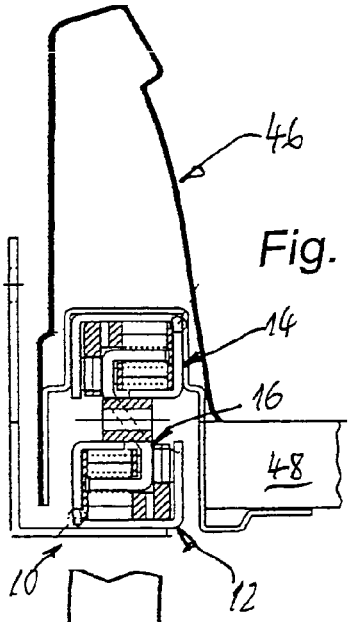
Fig. 15
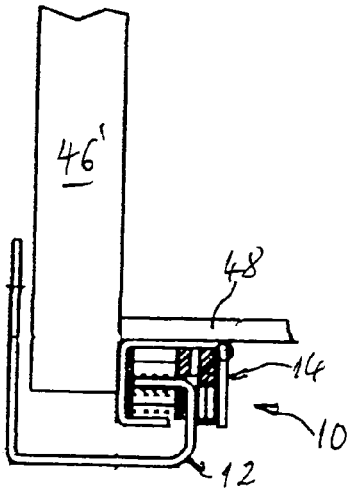
Fig. 16
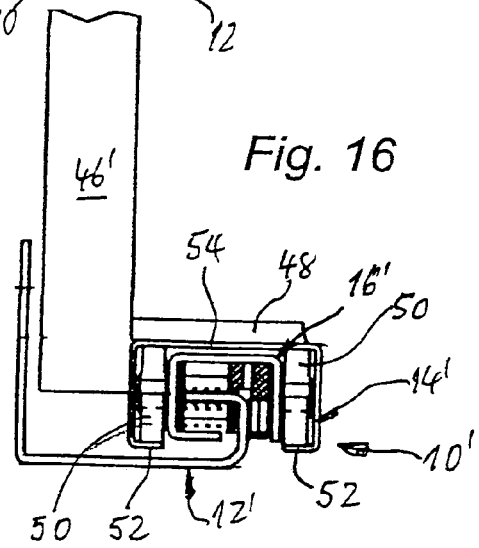

SLIDING GUIDE FOR DRAWERS AND OTHER FURNITURE PARTS SLIDE OUT OF THE BODY OF A PIECE OF FURNITURE

The invention relates to a pull-out guide for drawers and other furniture parts which can be pulled out of the carcass of a piece of furniture with a running rail which can be fixed on the drawer or on the furniture part and a carcass rail which can be fixed on the furniture carcass as well as—if appropriate—a central rail which is provided between these two rails, the rails being guided so as to be longitudinally displaceable relative to one another by load-transmitting anti-friction bearings which are in each case retained rotatably in cages.

Such pull-out guides, in which the carcass rail and the pull-out rail are mounted so as to be displaceable relative to one another by anti-friction bearings which are mounted in cages and roll on tracks of the rail, are known (e.g. AT 360 699 B) both as simple pull-out means in which the pull-out rail is mounted directly on the carcass rail and as double or full pull-out means in which a central rail is interposed between the running rail and the carcass rail, and because of their high loading capacity and also because of their light, smooth and energy-saving running they are increasingly used, ay least in high-quality pieces of furniture, for the mounting of drawers and other pull-out furniture items.

The object of the invention is to make further improvements to such pull-out guides in such a way that they can be construction in the most space-saving manner possible with at least the same loading capacity as the pull-out guides mounted on known anti-friction bearings, and in particular the object is a reduction in the height dimension of the pull-out guides constructed as full pull-out means with a central rail. In this case similar cages are used for the load-transmitting anti-friction bearings both for the direct mounting of the running rail on the guide rail of a simple pull-out means and for the mounting of the carcass rail on the central rail and of the central rail on the running rail.

Starting from a pull-out guide of the type referred to in the introduction, this object is achieved according to the invention in that the anti-friction bearings are constructed in a manner which is known per se as cylindrical rollers which are retained in the associated cage so as to be rotatable transversely with respect to the pull-out direction about a horizontal or vertical axis in each case, and which can roll on elongate planar tracks constructed on the respectively associated rails, and that at least some of the rollers which are mounted so as to be rotatable about the horizontal axis are disposed in the respectively associated cage so as to be offset with respect to one another laterally in the direction of their longitudinal central axes relative to other rollers which are mounted in the same cage so as to be rotatable about the horizontal axis and roll on the same tracks in each case. The laterally offset arrangement of the load-transmitting rollers in the cage makes it possible to widen the tracks in the rails which co-operate with the laterally offset rollers, so that the loading of the track is reduced and thus the loading capacity of the pull-out guide overall is improved.

In a preferred embodiment of the invention the cage or cages used in the particular case are each formed by an elongate plastic profile which in cross-section has substantially the shape of a U tilted by 90°, the receptacles for the rollers which are rotatable about the horizontal axis being provided in the arms of the U which are spaced from one another in the vertical direction, wherein a profile arm projecting at right angles in front of the open mouth of the U profile is attached to the free edge of one of the arms of the U of the respective cage, the receptacles for the rollers which are rotatable about the vertical axis are provided in the profile arm, and the profile arm retains these rollers in the region of and spaced from the second arm of the U.

In the space formed between the arms of the U of the cage a flat disc-like running roller is then advantageously disposed adjacent to the second arm of the U so as to be rotatable about a vertical axis, the diameter of the roller being chosen to be approximately equal to the clear distance between the vertical profile webs of the two rails which are mounted so as to be displaceable relative to one another by the rollers of the respective cage. Then in co-operation with the disc-like running roller the rollers which are rotatably mounted about the vertical axis in the profile arm which projects in front of the U profile then take over the guiding of the rail without play in the horizontal direction.

Then in a manner which is known per se stop dampers which come into abutment on an associated stop in each of the end positions of the pull-out path of the drawer are provided on at least one of the cages, and then the stop dampers are then advantageously formed in each case by a respective part-region which is integrally attached to the profile arm projecting in front of the open mouth of the U profile and is resiliently deformable by a predetermined amount relative to the profile arm in the pull-out direction and/or the retraction direction.

The running rail of the pull-out guide can be constructed in a manner which is known per se as an elongate hollow sheet metal section which is substantially rectangular or square in cross-section and which is provided only in the region of a corner with a longitudinally extending through slot for a vertical profile web of the adjoining rail which is retained so as to be displaceable relative to the running rail, whereby a narrow elongate profile arm, which has formed on its upper and lower flat faces the tracks for the rollers retained in the cage so as to be rotatable about the horizontal axis, is attached to the edge of the vertical profile web inside the running rail, whilst the rollers which are rotatable about the vertical axis or respectively the disk-like running roller roll on the opposing flat faces of the vertical profile web and the disc-like roller additionally rolls on the inner face of the profile arm, which lies opposite the vertical profile web, of the metal profile which forms the running rail.

In the case of a partial pull-out means, the vertical profile web which engages in the interior of the running rail is part of a channel-like sheet metal profile which forms the carcass rail, which can be fixed on the carcass wall, of a simple pull-out means.

If the pull-out guide is constructed as a full pull-out means with a central rail disposed between the running rail and the carcass rail, the vertical profile web which engages in the interior of the running rail is part of an elongate sheet metal profile which forms the central rail of a full pull-out means and which in its part-region lying outside the running rail is constructed symmetrically with the part-region lying inside the running rail and engages with the part-region lying outside the running rail in a part of the metal profile forming the carcass rail and of complementary construction in cross-section to the running rail profile and is retained so as to be longitudinally displaceable.

In a modified embodiment of the invention an elongate hollow section made from sheet metal which is of substantially rectangular or square cross-section can be provided as the central rail of a full pull-out means and is provided only in the region of one corner with a longitudinally extending through slot for a vertical profile web of the adjoining carcass rail which is retained so as to be displaceable relative to the central rail, whereby a narrow elongate profile arm, which has formed on its upper and lower flat faces the tracks for the rollers retained in the cage so as to be rotatable about the horizontal axis, is attached to the edge of the vertical profile web inside the running rail, whilst the rollers which are rotatable about the vertical axis or respectively the disc-like running roller roll on the opposing flat faces of the vertical profile web and the disc-like running roller additionally rolls on the inner face of the profile arm, which lies opposite the vertical profile web, of the metal profile which forms the central rail, whereby on the outer flat faces of the vertical profile arms of the central rail which are spaced from one another there are provided disc-shaped running rollers which are mounted so as to be rotatable about a horizontally extending axis at right angles to the pull-out direction and of which the circumferential surfaces roll in each case on two associated horizontal tracks of the running rail which are spaced from one another in the vertical direction. In this embodiment, in which the displaceable mounting of the central rail relative to the carcass rail is released in an analogous manner to a simple pull-out means, the central rail disposed inside the running rail is mounted in the running rail by outer disc-like rollers. The height of the full pull-out means thus obtained is substantially less than in the embodiments of full pull-out means described above, but here there is a certain—albeit small—widening of the width of the pull-out guide measured over the outer profile arms of the running rail. In this embodiment the pull-out guide according to the invention is particularly suitable for the arrangement of the running rail immediately adjacent to the side wall frame thereof on the underside of the drawer bottom in a so-called flush-mounted arrangement. If this embodiment is to be used in drawers with side wall frames formed by hollow chamber profiles with a different underside, it must be ensured that the side wall frame has a sufficient internal width in its lower region which receives the running rail in order for the running rail to be disposed there.

In this embodiment the running rail is advantageously in the form of a substantially U-shaped profile which is tilted by 180° about the central longitudinal axis and which is provided in each case with narrow strip-shaped profile portions directed at right angles to one another in the lower edge region of the profile arms which point downwards, so that the inner faces which point towards each other of the strip-shaped profile portions on the one hand and of the opposing profile web on the other hand form the tracks for the disc-shaped running rollers.

The invention is explained in greater detail in the following description in conjunction with the drawings, in which:

FIG. 3 shows a perspective view of a cage on the rails of the pull-out guide according to FIG. 1 in which rotatably mounted rollers are guided so as to be longitudinally displaceable relative to one another;

FIG. 4 shows a side view of the cage in the direction of the arrow 4 in FIG. 3;

FIG. 5 shows a plan view in the direction of the arrow 5 in FIG. 4;

FIG. 6 shows a view from below in the direction of the arrow 6 in FIG. 4;

FIG. 7 shows a view of the cage in the direction of the arrow 7 in FIG. 4;

FIG. 8 shows a view of the cage in the direction of the arrow 8 in FIG. 4;

FIG. 9 shows on an enlarged scale the part of the cage placed within the circle 9 shown by dash-dot lines;

FIG. 10 shows a cross-section through a hollow chamber frame with adjoining portion of a drawer bottom which are mounted in a cupboard carcass so that they can be pulled out by a pull-out guide according to the invention constructed as a simple pull-out means;

FIG. 11 shows a representation corresponding to that of FIG. 10 of the mounting of the drawer side wall by means of a pull-out guide constructed as a full pull-out means;

FIG. 12 shows the mounting of a drawer side wall by means of a variant of a pull-out guide according to the invention constructed as a full pull-out means;

FIG. 13 shows a variant of a pull-out guide according to the invention constructed as a simple pull-out means which corresponds functionally to the simple pull-out means according to FIG. 10;

FIG. 14 shows a variant of a pull-out guide according to the invention which is functionally comparable to the pull-out guide according to FIG. 11;

FIG. 15 shows a pull-out guide according to the invention constructed as a simple pull-out means in a flush-mounted arrangement on the underside of the bottom of a drawer; and FIG. 16 shows a pull-out guide according to the invention which is constructed as a full pull-out means and is disposed in a flush-mounted arrangement on the underside of a drawer bottom and which in its basic construction corresponds to the embodiment of the pull-out guide shown in FIG. 12.

Figure 1:
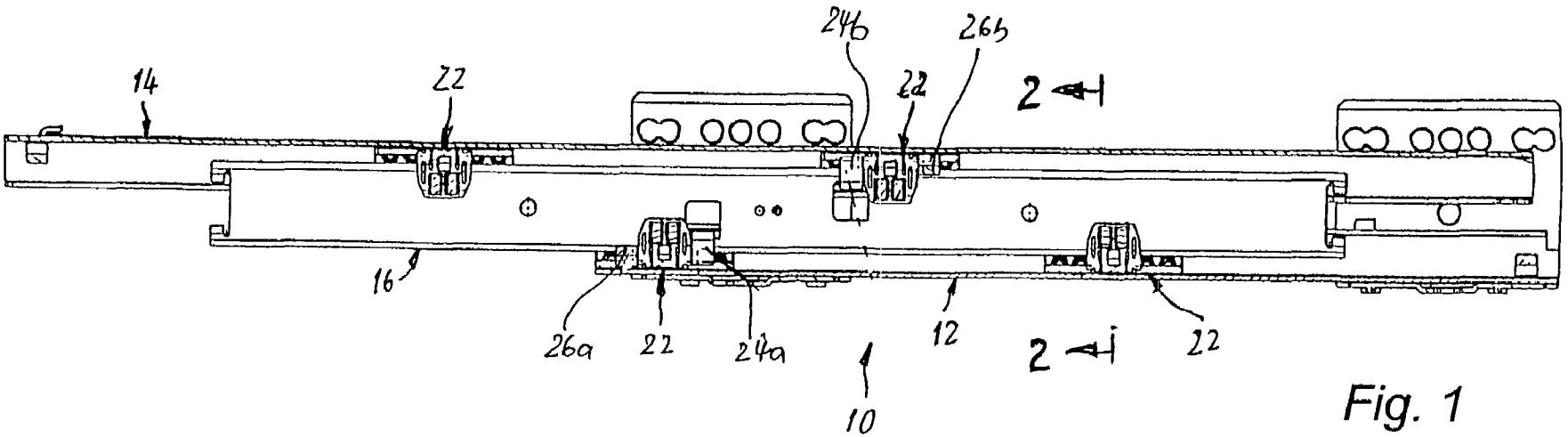
FIG. 1 shows a side view of a pull-out guide constructed in the manner according to the invention as a full pull-out means.
Figure 2:
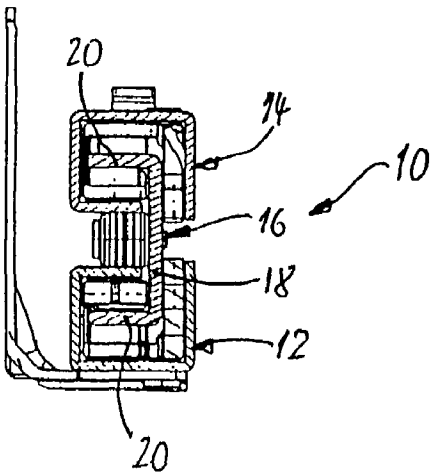
FIG. 2 shows a side view in the direction of the arrows 2-2 in FIG. 1.

FIGS. 1 and 2 shows a first embodiment of a pull-out guide according to the invention which is denoted as a whole by 10 and which in the illustrated case is constructed as a full pull-out means. The pull-out guide 10 is constituted by three rails which are guided so as to be longitudinally displaceable relative to one another, namely a carcass rail 12 which can be fixed on the inner face of the side wall of a furniture carcass, a running rail 14 which can be fixed on the furniture part to be pulled out, i.e. as a rule the drawer, in the region of the underside of the side wall thereof or in the adjoining region of the drawer bottom, and a central rail 16 which is disposed between the carcass rail and the running rail.

The central rail 16 is in the form of a U profile which is tilted by 90° about its longitudinal axis and thus is constituted by an elongate web surface 18 which is vertical in the proper assembly position and two elongate arm surfaces 20 which are each integrally attached to the edges of the web surface and are bent round at right angles. The edge regions of the web surfaces 18, together with the respective associated arm surfaces 20, are inserted into the interior of the carcass rail 12 constructed as a hollow section on the one hand and of the running rail 14 on the other hand, Ensuring longitudinally displaceable guiding without play of the central rail 16 relative to the carcass rail 12 and the running rail by way of anti-friction bearings which are in each case retained so as to be rotatable in cages 22. The configuration of these cages and the arrangement of the anti-friction bearings which are constructed as load-transmitting cylindrical rollers or disc-shaped running rollers in the respective cage 22 is described further below in connection with FIGS. 3 to 9. In FIG. 1 it can be seen that in each case two cages 22 which are spaced from one another in the longitudinal direction are provided between the carcass rail 12 and the central rail 16 on the one hand and between the central rail 16 and the running rail 14 on the other hand. Stops 24*a*, 24*b* provided on the central rail 16 each co-operate with an associated cage 22 in the sense of limiting the pull-out path of the central rail relative to the carcass rail 12 or to the running rail 14 respectively, and stops 26*a*, 26*b* respectively which co-operate with the cages are provided on the carcass rail 12 on the one hand and on the running rail 14 on the other hand and limit the pull-out path of these rails relative to the central rail 16.

In the embodiments of the pull-out guide described in connection with FIGS. 1, 2 and yet to be described in connection with FIGS. 11 and 14, both the carcass rails 12 and the running rail 14 are constructed as elongate hollow sheet metal sections of rectangular or square cross-section which have a through slot for the vertical profile web of the central rail 16 only in the region of one corner.

FIGS. 3 to 9 show the configuration of the cages 22 and the arrangement of the load-transmitting anti-friction bearings which are retained so as to be rotatable in the cage 22.

The cage 22 is formed by an elongate plastic profile which in cross-section has substantially the shape of a U tilted by 90°, receptacles being provided in the arms of the U 28 which are spaced from one another in the vertical direction for the rollers 30 which are rotatable about the horizontal axis and which roll on the arm surfaces 20 of the central rail 16 on the one hand and on the opposing inner surfaces of the carcass rail 12 on the one hand or of the running rail 14 on the other hand and thus transmit to the carcass wall the dead weight of the drawer which acts in the vertical direction. A profile arm 32 projecting at right angles in front of the open mouth of the U profile is integrally attached to the free edge of one of the arms of the U 28 of the respective cage 22, and receptacles for rollers 34 which are rotatable about the vertical axis are provided on the profile arm and in the proper assembly position lie between the vertical web surface 18 of the central rail 16 and the inner surface of the carcass rail 12 or running rail 14 respectively lying opposite the central rail. Furthermore, a disc-shaped running roller 36 is also retained in the interior of the cage 22 so as to be rotatable about a vertical axis, the circumferential surface of the running roller rolling on the vertical web surface 18 of the central rail 16 on the one hand and on the opposing inner surface of the respective appertaining carcass rail 12 or running rail 14. Thus the rollers 34 which are mounted in the cage 22 so as to be rotatable about the vertical axis and the disc-shaped running roller 36 transmit horizontal forces directed transversely with respect to the pull-out direction between the rails. The profile arm 32 which receives the rollers 34 which are retained so as to be rotatable about the vertical axis and which also co-operates with the previously mentioned stops 24*a*, 24*b* and 26*a*, 26*b* is constructed in such a way that in each case as it encounters one of the said stops it exhibits a damping effect, i.e. it cushions the impact. For this purpose cut-outs 40 which are open on one side are provided in the profile arm 32, whereby the outer regions of the profile arm 32 are resiliently deformable relative to the central region by the dimension of the width of the cut-out. Thus as the profile arm encounters one of the aforementioned stops the impact is initially converted into resilient deformation work of the profile arm and thus is reduced.

FIGS. 10 to 16 show various embodiments of pull-out guides 10 according to the invention in their proper arrangement on or in the underside of a drawer side wall (FIGS. 10 to 14) or adjacent to the drawer side wall on the underside of the bottom of a drawer (FIGS. 15 and 16).

In the cases illustrated in FIGS. 10 to 14 the drawer side wall is constructed in each case as a metal side wall frame 46 constructed as a hollow chamber profile from sheet metal, on which the side edge of a plate-shaped drawer bottom 48 is retained, whilst FIGS. 15 and 16 show the flush-mounted arrangement of the pull-out guide on the bottom of the drawer immediately adjacent to the drawer side wall made from wood or wooden panel material.

In FIGS. 10, 13 and 15 the pull-out guide is constructed as a simple pull-out means, i.e. the running rail 14 is retained directly on the carcass rail 12 so as to be longitudinally displaceable without an interposed central rail.

In FIGS. 11 and 14 as well as 12 and 16 the particular pull-out guide shown is constructed as a full pull-out means and corresponds functionally to the pull-out guide 10 already described in connection with FIGS. 1 and 2, only the shape of the central rail 16 in the region of the profile web 18 being different. In FIGS. 12 and 16, on the other hand, the full pull-out means is provided by the fact that in practice a simple pull-out means of the type illustrated in FIGS. 10, 13 and 15 is expanded to form a full pull-out means by an additional metal profile 12' of reverse U shape which receives the original running rail profile so that it is longitudinally displaceable. The original running rail profile then functionally becomes the central rail 16' and the reverse U-shaped profile 12' takes on the function of the running rail. In both embodiments disc-shaped running rollers 50 which are mounted so as to be rotatable about horizontal axes on the opposing vertical outer faces of the central rail 16' serve for displaceable guiding of the running rail 12' on the central rail 16'. It can be seen that the last described embodiments are of substantially lower construction than the embodiments according to FIGS. 11 and 14, so that they are particularly suitable for the flush-mounting on the drawer according to FIG. 16.

The invention claimed is:

1. Pull-out guide (10) for a drawer and other furniture part capable of being pulled out of a carcass of a piece of furniture comprising a running rail (14) fixable on the drawer or on the furniture part and a carcass rail (12) fixable on the furniture carcass, a central rail (16) provided between the running rail (14) and the carcass rail (12), the rails (14 and 16) being guided so as to be longitudinally displaceable relative to one another by load-transmitting anti-friction bearings which are in each case retained rotatably in cages (22), wherein the anti-friction bearings are constructed as cylindrical rollers (30; 34) rotatable transversely in pull-out direction about a horizontal or vertical axis in each case, and which are capable of rolling on elongated planar tracks constructed on the respectively associated rails, and at least some of the cylindrical rollers (30) are mounted so as to be rotatable about the horizontal axis and are disposed in the respectively associated cage (22) so as to be offset with respect to one another laterally in the direction of their longitudinal central axes relative to other rollers (30) which are mounted in the same cage (22) so as to be rotatable about the horizontal axis and roll on the same tracks in each case, wherein the cages (22) are formed by an elongate plastic U-shaped-profile (28) having two arms tilted by 90 degrees, receptacles for the rollers (30) are provided in the arms of the U-shaped profile (28) which are spaced from one another in vertical direction, and wherein a profile arm (32) projecting at right angles in front of the open mouth of the U-shaped profile is attached to a free edge of one of the arms of the U-shaped profile (28) of the respective cage (22), the receptacles for the rollers (34) which are rotatable about the vertical axis are provided in the profile arm, and the profile arm retains these rollers (34) in the region of and spaced from the second arm of the U-shaped profile (28).

2. The pull-out guide as claimed in claim 1, wherein in a space formed between the arms of the U-shaped profile (28) a flat disc-like shaped running roller (36) is disposed adjacent to a second arm of the U-shaped profile (28) so as to be rotatable about a vertical axis, the diameter of the roller being chosen to be approximately equal to a clear distance between vertical profile webs of the two rails (12, 16; 16, 14) which are mounted so as to be displaceable relative to one another by the rollers of the respective cages.

3. The pull-out guide as claimed in claim 1, wherein stop dampers being in abutment on an associated stop (24*a*; 24*b*; 26*a*; 26*b*) in each of the end positions of a pull-out path are provided on at least one of the cages (22), and the stop dampers are formed in each case by a respective part-region which is integrally attached to the profile arm (32) projecting in front of the open mouth of the U-shaped profile and is resiliently deformable by a predetermined amount relative to the profile arm (32) in the pull-out direction and/or retraction direction.

4. The pull-out guide as claimed in claim 1, wherein the running rail (14) is constructed as an elongated hollow sheet metal section which is substantially rectangular or square in cross-section and which is provided only in a region of a corner with a longitudinally extending through-slot for a vertical profile web (18) of the adjoining rail which is retained so as to be displaceable relative to the running rail (14), whereby a narrow elongate profile arm (20), which has formed on its upper and lower flat faces tracks for the rollers (30) 50 as to be rotatable about the horizontal axis, is attached to an edge of the vertical profile web (18) inside the running rail, whilst the rollers (34) which are rotatable about the vertical axis or respectively the disc-shaped running roller (36) roll on opposing flat faces of the vertical profile web and the disc-like roller (36) additionally rolls on the inner face of the profile arm, which lies opposite the vertical profile web, of the metal profile which forms the running rail (14).

5. The pull-out guide as claimed in claim 4, wherein the vertical profile web which engages inside the running rail (14) is part of a channel-shaped sheet metal profile which forms the carcass rail (12), which can be fixed on the carcass wall, of a partial pull-out means.

6. The pull-out guide as claimed in claim 4, wherein the vertical profile web (18) which engages in the interior of the running rail (14) is part of an elongate sheet metal profile which forms the central rail (14) of a full pull-out means and which in its part-region lying outside the running rail (14) is constructed symmetrically with the part-region lying inside the running rail and engages with the part-region lying outside the running rail (14) in a part of the metal profile forming the carcass rail (12) and of complementary construction in cross-section to the running rail profile and is retained so as to be longitudinally displaceable.

7. The pull-out guide as claimed in claim 1, wherein an elongate hollow section made from sheet metal having substantially rectangular or square cross-section is provided as the central rail (16') of a full pull-out means and is provided only in the region of one corner with a longitudinally extending through slot for a vertical profile web of an adjoining carcass rail (12') which is retained so as to be displaceable relative to the central rail, whereby a narrow elongate profile arm (20), which has formed on its upper and lower flat faces the tracks for the rollers (30) retained in the cage (22) so as to be rotatable about the horizontal axis, is attached to the edge of the vertical profile web inside the running rail, whilst the rollers (34) which are rotatable about the vertical axis or respectively the disc-shaped running roller roll on the opposing flat faces of the vertical profile arm, which lies opposite the vertical profile web, of the metal profile which forms the central rail (16'), and that on the outer flat faces of the vertical profile arms of the central rail (16') which are spaced from one another there are provided disc-shaped running rollers (50) which are mounted so as to be rotatable about a horizontally extending axis at right angles to the pull-out direction and of which the circumferential surfaces roll in each case on two associated horizontal tracks of the running rail (14) which are spaced from one another in the vertical direction.

8. The pull-out guide as claimed in claim 7 wherein the running rail (14') is in the form of a substantially U-shaped profile which is tilted by 180 degrees about the central longitudinal axis and which is provided in each case with narrow strip-shaped profile portions (52) directed at right angles to one another in the lower edge region of the profile arms which point downwards, so that the inner faces which point towards each other of the strip-shaped profile portions (52) on the one hand and of the opposing profile web (54) on the other hand form the tracks for the disc-shaped running rollers (50).

* * * * *

UNITED STATES PATENT AND TRADEMARK OFFICE

CERTIFICATE OF CORRECTION

PATENT NO. : 7,396,092 B2
APPLICATION NO. : 10/519220
DATED : July 8, 2008
INVENTOR(S) : Christian Prentner et al.

It is certified that error appears in the above-identified patent and that said Letters Patent is hereby corrected as shown below:

On the title page Item [73], the Assignees address,
[73] Assignee, "Alfit AG, Goetzis (AU)" should read -- Alfit AG, Goetzis (AT) --.

Column 7, line 24 "for the rollers (30) 50 as to be" should read -- for the rollers (30) so as to be --.

Signed and Sealed this

Twenty-fourth Day of November, 2009

David J. Kappos

David J. Kappos
*Director of the United States Patent and Trademark Office*